US007158734B2

(12) United States Patent
Kawamata et al.

(10) Patent No.: US 7,158,734 B2
(45) Date of Patent: Jan. 2, 2007

(54) IMAGE FORMING APPARATUS

(75) Inventors: Kunimasa Kawamata, Saitama (JP); Hidekazu Yamagiwa, Saitama (JP); Kazuaki Komatsubara, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 108 days.

(21) Appl. No.: 11/073,597

(22) Filed: Mar. 8, 2005

(65) Prior Publication Data

US 2006/0029417 A1 Feb. 9, 2006

(30) Foreign Application Priority Data

Aug. 3, 2004 (JP) ..... P.2004-226936

(51) Int. Cl.
*G03G 21/20* (2006.01)

(52) U.S. Cl. ..... 399/91; 399/107

(58) Field of Classification Search ..... 399/125, 399/91, 107, 367, 391, 393, 411
See application file for complete search history.

(56) References Cited

FOREIGN PATENT DOCUMENTS

| | | | |
|---|---|---|---|
| JP | 04-271364 | * | 9/1992 |
| JP | 04-277762 | * | 10/1992 |
| JP | 2002-365985 A | | 12/2002 |

* cited by examiner

*Primary Examiner*—Hoang Ngo
(74) *Attorney, Agent, or Firm*—Sughrue Mion, PLLC

(57) ABSTRACT

A second opening and closing door has a main body of the second opening and closing door, a sound absorbing member and a sound absorbing member cover. The sound absorbing member covers almost the entire surface of the main body of the second opening and closing door facing a guide member. The sound absorbing member cover is dyed black and made of an antistatic-treated cloth material which has air permeability, and is designed to cover almost the entire surface of the sound absorbing member facing the guide member. Further, the sound absorbing member cover is dyed with a dye which does not contain carbon, so that carbon-containing fibrous materials can be prevented from floating in an image forming apparatus while the light-shielding effect can be maintained.

13 Claims, 9 Drawing Sheets

IMAGE FORMING APPARATUS

BACKGROUND OF THE INVENTION

1. Field of the Invention

The present invention relates to an image forming apparatus such as a printer, a copying machine or a facsimile.

2. Background Art

For example, when an electro-photographic image forming apparatus is operated, noise associated with the operation of the apparatus is generated. Noise of an image forming apparatus includes, for example, a sound caused by sliding friction which is generated when a recording medium to which an image is to be transferred are conveyed.

As for the image forming apparatus, it is known that a fibrous sound absorbing material, such as polyester fiber, having sound-absorbing function in the audible region is stuck on an inner surface of an external cabinet surrounding the apparatus, so prevents noise from leaking out of the image forming apparatus, as disclosed in JP-A-2002-365985.

The inventors of the present invention have found out that the above-mentioned conventional image forming apparatus has a problem in that the image quality of an image to be transferred to a recording medium is deteriorated by the fact that fine fibers such as the sound absorbing material float in the image forming apparatus.

For example, if a fibrous sound absorbing material provided in the image forming apparatus contains carbon, fibers containing fine carbon float inside the image forming apparatus. In the image forming apparatus, if the carbon-containing fibrous materials float in the vicinity of an intermediate transfer belt 1 charged with a predetermined electric potential, as shown in FIG. 9, the carbon-containing fibrous materials are liable to stick to the intermediate transfer belt 1 in a upright state which protrude from the intermediate transfer belt 1. In this way, the inventors have found out that the carbon-containing fibrous materials sticking to the intermediate transfer belt 1 is stuck into a photoreceptor 5 in the vicinity of a primary transfer roller 4 and breaks through a photoconductive layer of the surface of the photoreceptor 5 when the intermediate transfer belt 1 rotates along belt-tensioning rollers 2 and 3.

A portion of the photoconductive layer of the photoreceptor 5 through which the carbon-containing fibrous materials breaks becomes an unrecoverable damage of the photoconductive layer, which may cause a defect in the image quality. Further, even in case the sound absorbing member is covered with a sound absorbing member cover made of air-permeable cloth in order to prevent fibers from being isolated from the sound absorbing member, if the fibers of the sound absorbing member cover are dyed black with pigment which contain carbon, noise can be prevented from leaking out of the image forming apparatus while the light-shielding effect inside the image forming apparatus can be maintained. However, since the carbon-containing fibrous materials are isolated from the sound absorbing cover, the same problem occurs.

Moreover, the carbon-containing fibrous materials which float in the image forming apparatus may cause the deterioration of image quality even when they simply stick to the photoreceptor 5 and the intermediate transfer belt 1. For example, if carbon-containing fibrous materials stick to the photoreceptor 5 or the intermediate transfer belt 1 from the time when the photoreceptor or the intermediate transfer belt is cleaned to the time when the transfer of an image therefrom is performed, a defect occurs in the image quality.

SUMMARY OF THE INVENTION

The object of the present invention is to provide an image forming apparatus capable of reducing noise without deteriorating image quality.

In order to achieve the above object, as a first aspect of the present invention, there is provided an image forming apparatus including an image carrier for carrying a charged developer image, a main body of the image forming apparatus for accommodating the image carrier, a sound absorbing member which prevents a noise source inside the main body of the image forming apparatus from leaking out of the main body of the image forming apparatus, in which the sound absorbing member is dyed in a dark color with a dye. Thus, noise inside the main body of the image forming apparatus can be prevented from leaking out of the main body of the image forming apparatus while the diffusion of stray light can be suppressed. Therefore, noise can be reduced without causing the deterioration of image quality caused by stray light.

In addition, the image carrier includes an intermediate transfer medium, such as an intermediate transfer belt.

Further, as a second aspect of the present invention, there is provided an image forming apparatus including an image carrier for carrying a charged developer image, a main body of the image forming apparatus for accommodating the image carrier, a sound absorbing member which prevents a noise source inside the main body of the image forming apparatus from leaking out of the main body of the image forming apparatus, a sound absorbing member cover for covering the sound absorbing member, in which the sound absorbing member cover is dyed in a dark color with a dye. Thus, similar to the above first aspect, noise can be reduced without causing the deterioration of image quality caused by stray light.

Further, as a third aspect of the present invention, there is provided an image forming apparatus including an image carrier for carrying a charged developer image, a main body of the image forming apparatus for accommodating the image carrier, a sound absorbing member which prevents a noise source inside the main body of the image forming apparatus from leaking out of the main body of the image forming apparatus, a sound absorbing member cover for covering the sound absorbing member, in which the sound absorbing member cover is dyed in a dark color with a dye which does not contain carbon. Therefore, a carbon-containing fibrous material can be prevented from sticking to the image carrier by an electrostatic force, and the image quality of an image to be formed can be prevented from being deteriorated. Also, a noise source inside the main body of the image forming apparatus can be prevented from leaking out of the main body of the image forming apparatus while the light-shielding effect can be maintained. Thus, noise can be reduced without causing the deterioration of image quality caused by stray light.

Preferably, the dye does not contain carbon-containing fibrous material. Thus, a carbon-containing fibrous material can be prevented from floating in an image forming apparatus which utilizes an electrostatic force. Therefore, the carbon-containing fibrous material can be prevented from being stuck to the image carrier by an electrostatic force, and the image quality of an image to be formed can be prevented from being deteriorated.

Further, preferably, the sound absorbing member and the sound absorbing member cover are dyed black. Thus, the light-shielding effect can be improved by the sound absorbing member or the sound absorbing member cover because the brightness of the sound absorbing member or the sound absorbing member cover is low. Further, a blot stained by developer in the image forming apparatus can be hidden from sight. Also, the operability, for example, in removing a recording medium jammed in an image forming apparatus, can be improved because a recording medium of bright colors such as white, which is frequently used, attracts attention.

Further, preferably, the sound absorbing unit, the sound absorbing member and the sound absorbing member cover are provided inside the opening and closing door facing a conveying passage for conveying a recording medium. Further, preferably, the opening and closing door faces the conveying passage via a guide member. Thus, the sound absorbing unit, the sound absorbing member and the sound absorbing member cover can be easily arranged so as to prevent noise inside the main body of the image forming apparatus from leaking out of the main body of the image forming apparatus.

Further, preferably, the sound absorbing unit, the sound absorbing member and the sound absorbing member cover are arranged to cover a void formed between the main body of the image forming apparatus and the guide member. Thus, noise inside the main body of the image forming apparatus can be efficiently prevented from leaking out of the main body of the image forming apparatus.

According to the present invention, noise can be reduced without causing the deterioration of image quality caused by stray light.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Hereinafter, an embodiment of the present invention will be described with reference to the accompanying drawings.

Figure 1:
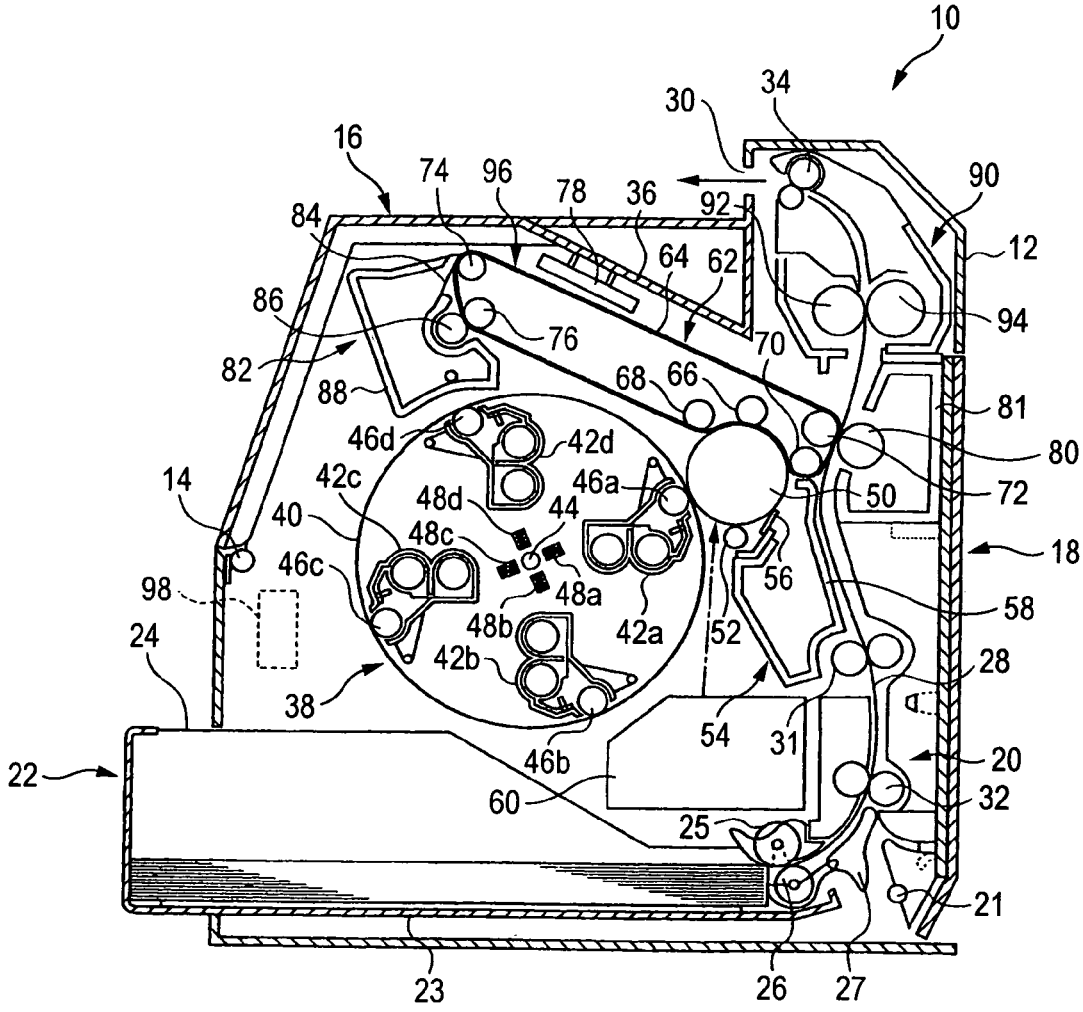
FIG. 1 is a schematic view showing an image forming apparatus related to an embodiment of the present invention.
Figure 2:
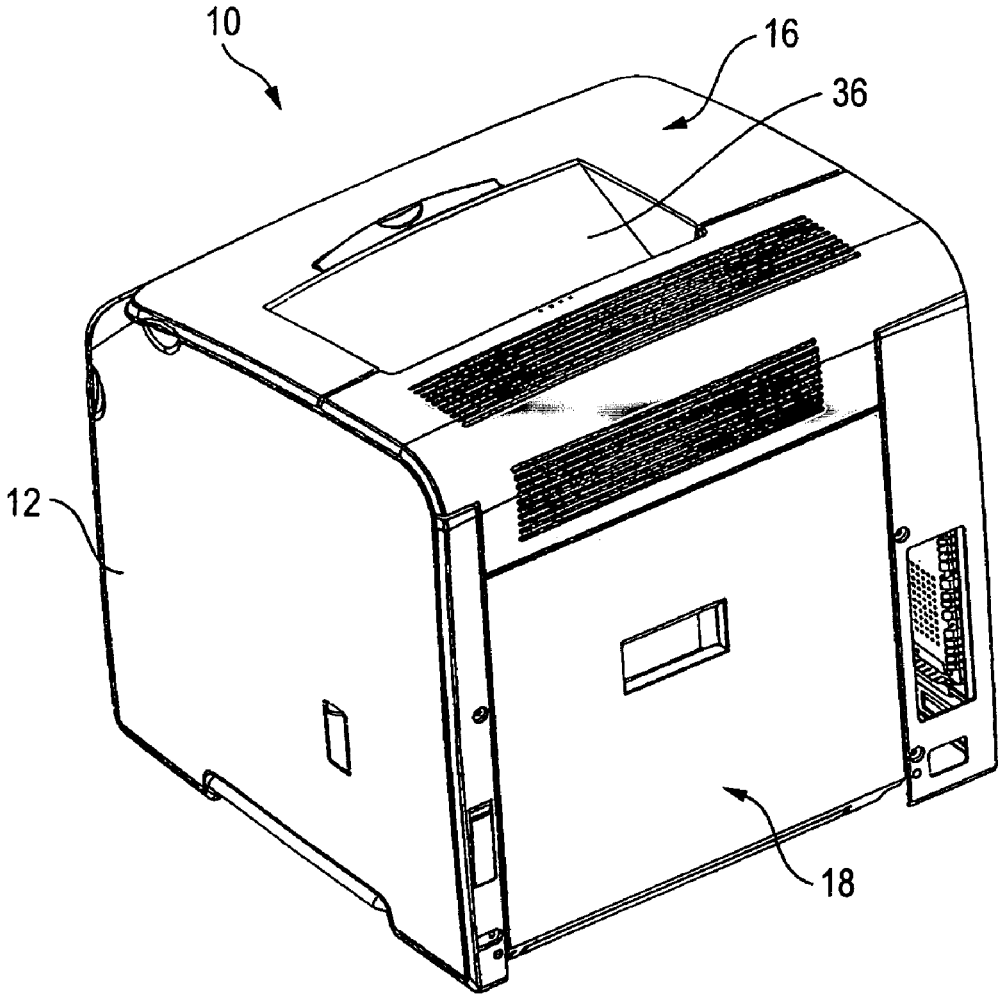
FIG. 2 is a perspective view showing an appearance of the image forming apparatus related to the embodiment of the present invention.

FIGS. 1 and 2 show the outline of an image forming apparatus 10 related to the embodiment of the present invention.

The image forming apparatus 10 has a main body 12 of the image forming apparatus. An upper portion of the main body 12 of the image forming apparatus is provided with a first opening and closing door 16 rotatable about a fulcrum 14. Further, a second opening and closing door 18 is provided on the rear side of the main body 12 of the image forming apparatus (the right side in FIG. 1), that is, on the rear side of a guide member 20, which will be described later, and is freely rotatable about a fulcrum 21 of the guide member 20 along with the guide member 20 with respect to the main body 12 of the image forming apparatus.

For example, a one-stage recording medium supplying unit 22 is disposed at a lower portion of the main body 12 of the image forming apparatus. The recording medium supplying unit 22 has a main body 23 of the recording medium supplying unit, a recording medium supplying cassette 24 where a recording medium is received. A feed roller 25 for supplying a recording medium from the recording medium supplying cassette 24 and a retard roller 26 for separating recording media one by one are disposed at an upper portion around a deep end of the recording medium supplying cassette 24. A movable member 27 is rotatably provided around the retard roller 26 for guiding a recording medium.

A conveying passage 28 is a recording medium passage from the feed roller 25 to an outlet 30, formed by the guide member 20 etc. in which a plurality of ribs is arranged toward the inside of the main body 12 of the image forming apparatus from the rear side of the main body 12 of the image forming apparatus. The conveying passage 28 is formed substantially vertically from the recording medium supplying unit 22 to a fixing device 90 which will be described later. The fulcrum 21 is provided at the bottom of the guide member 20, and the guide member 20 rotates freely around the fulcrum 21. A secondary transfer roller 80 and a secondary transfer back-up roller 72, which will be described later, are arranged upstream of the fixing device of the conveying passage 28. Further, a resist roller 31 is arranged upstream of the secondary transfer roller 80 and the secondary transfer back-up roller 72. Conveying rollers 32 are arranged between the resist roller 31 and the feed roller 25 or the retard roller 26. Also, a discharging roller 34 is arranged around the outlet 30 of the conveying passage 28.

Accordingly, a recording medium, which is fed by the feed roller 25 from the recording medium supplying cassette 24 of the recording medium supplying unit 22, is separated by the retard roller 26, and only the uppermost one of recording media is led to the conveying passage 28 and passes between the conveying rollers 32, and is temporarily stopped by the resist roller 31. Then, the recording medium passes between the secondary transfer roller 80 and the secondary transfer back-up roller 72, which will be described later, at a predetermined timing. At this time, a developer image is transferred onto the recording medium, and the developer image transferred is fixed by the fixing device 90. Then, the discharging roller 34 discharges the recording medium to a discharging portion 36 provided at the top of the first opening and closing door 16 from the outlet 30. The discharging portion 36 whose outlet side is lower, ascends gradually toward the front (the left side in FIG. 1).

A rotary developing device 38 is arranged, for example, substantially in the middle of the main body 12 of the image forming apparatus. The rotary developing device 38 has developing units 42*a* to 42*d* for forming developer images of four colors of yellow (Y), magenta (M), cyan (C) and black (B) in a main body 40 of the developing unit, rotates to the left (counterclockwise in FIG. 1) about the center 44 of the rotary developing unit. The respective developing units 42*a* to 48*d* have developing rollers 46*a* to 46*d*, and are pressed in a direction normal to the main body 40 of the developing unit by elastic bodies, for example, such as coil springs 48*a* to 48*d*. Specifically, the developing rollers 46*a* to 46*d* of the developing units 42*a* to 42*d* are arranged at the circumference of the main body 40 of the developing unit at equal intervals of 90° about the center 44 of the rotary developing unit center, and abut an image carrier 50 and makes an electrostatic latent image on the image carrier visualized with developers of respective colors.

The rotary developing device 38 is arranged to abut the image carrier 50. The image carrier 50 is made of, for example, a tubular aluminum pipe, and has a photoconductive layer formed on its surface. The photoconductive layer allows the image carrier 50 to carry a developer image visualized with a developer and an electrostatic latent image formed by beams of light such as laser.

A charging device 52 composed of charging rollers for uniformly charging the image carrier 50 is arranged below the image carrier 50. Further, the image carrier 50 abuts an image carrier cleaner 54 further upstream than the charging device 52 in the rotating direction of the image carrier 50. The image carrier cleaner 54 is composed of a cleaning blade 56 which scrapes developer remaining in the image carrier 50, and a developer collecting bottle 58 which collects the developer scraped by the cleaning blade 56.

In addition, for example, the rear side (the right side in FIG. 1) of the developer collecting bottle 58 are formed with ribs, and is formed into a curved surface to form a part of the conveying passage so that recording media are smoothly carried.

An exposure device 60, which writes a latent image in the image carrier 50 charged by the charging device 52 with beams of light such as laser, is arranged below the rotary developing device 38. Further, an intermediate transfer device 62 for carrying the developer image to a secondary transfer position after the developer image visualized by the rotary developing device 38 is primarily transferred at a primary transfer position is arranged in the top of the rotary developing device 38.

The intermediate transfer device 62 is composed of, for example, an intermediate transfer medium 64 such as an intermediate transfer belt, a primary transfer roller 66, a lap-in roller 68, a lap-out roller 70, the secondary transfer back-up roller 72, a scraper back-up roller 74 and a brush back-up roller 76. The intermediate transfer medium 64 has, for example, elasticity and is stretched substantially flatly to have long sides and short sides above the rotary developing device 38. The long sides of the upper surface of the intermediate transfer medium 64 is stretched to be, for example, substantially parallel to the discharging portion 36 which is provided at the top of the main body 12 of the image forming apparatus. Further, the intermediate transfer medium 64 has a primary transfer portion (a lap area of the image carrier) abutting the image carrier 50 in a lapped state between the lap-in roller 68 arranged upstream of the primary transfer roller 66 and the lap-out roller 70 arranged downstream of the primary transfer roller 66, which are arranged below the long sides of the intermediate transfer medium 64. Further, the intermediate transfer medium 64 is wound around a predetermined range of the image carrier 50 and follows the rotation of the image carrier 50. In this way, the intermediate transfer medium 64 has a developer image on the imager carrier 50 primarily and superposably transferred thereon in order of, for example, yellow, magenta, cyan and black, by the primary transfer roller 66, and carries the developer image primarily transferred toward the secondary transfer roller 80 which will be described later.

In addition, the lap-in roller 68 and the lap-out roller 70 are separated from the image carrier 50.

Moreover, a planar surface (short side) is formed at rear side (the right side in FIG. 1) of the intermediate transfer medium 64 by the lap-out roller 70 and the secondary transfer back-up roller 72, and the planar surface becomes a secondary transfer portion and faces the conveying passage 28.

In addition, in the secondary transfer portion, the lap-out roller 70 is arranged to have the angle of, for example, 12° between the intermediate transfer medium 64 and the conveying passage 28.

The scraper back-up roller 74 assists a scraper 84, which will be described later, in scraping developer remaining on the intermediate transfer medium 64 after being secondarily transferred, and the brush back-up roller 76 assists a scraper 86, which will be described later, in scraping developer remaining on the intermediate developer 64 after being secondarily transferred.

Above the long sides of the intermediate transfer medium 64, a sensor 78 such as a reflective photosensor is fixedly provided on the rear face (inside) of the first opening and closing door 16. The sensor 78 reads a developer patch formed on the intermediate transfer medium 64, detects the position of the intermediate transfer medium 64 in its rotating direction, and detects the density of the developer.

The secondary transfer roller 80 faces the secondary transfer back-up roller 72 of the intermediate transfer device 62 with respect to the conveying passage 28. Specifically, the secondary transfer position of the secondary transfer portion is between the secondary transfer roller 80 and the secondary transfer back-up roller 72. The secondary transfer roller 80 secondarily transfers the developer image primarily transferred to the intermediate transfer medium 64 to a recording medium at the secondary transfer position by the assistance of the secondary transfer back-up roller 72. Here, the secondary transfer roller 80 is separated from the intermediate transfer medium 64 while the intermediate transfer medium 64 rotates three times, that is, while the developer image of three colors of yellow, magenta and cyan are carried. Further, the secondary transfer roller 80 abuts the intermediate transfer medium 64 when the black developer image is transferred. In addition, a secondary transfer roller accommodation portion 81 accommodates the secondary transfer roller 80 so as to be exposed at the secondary accommodation portion 81 is fixed to the main body 12 of the image forming apparatus.

In addition, a predetermined potential difference occurs between the secondary transfer roller 80 and the secondary transfer back-up roller 80. For example, when the voltage of the secondary transfer roller 80 is high, the secondary transfer back-up roller 72 is connected to the ground (GND), etc. In other words, the intermediate transfer medium 64 has a predetermined electric potential between the secondary transfer roller 80 and the secondary transfer back-up roller 72.

An intermediate transfer medium cleaner 82 abuts an end of the intermediate transfer medium 64 opposite to the image carrier 50. The intermediate transfer medium cleaner 82 is composed of, for example, a cleaning scraper 84 which scrapes and cleans the developer remaining on the intermediate transfer medium 64 after the secondary transfer, a brush roller 86 which further scrapes the developer which remains after the cleaning by the scraper 84, and a developer collecting bottle 88 which collects the developer scraped by the scraper 84 and the brush roller 86. The scraper 84 is made of a stainless sheet, and a voltage whose polarity is opposite to the polarity of the developer is applied to the scraper 84. The brush roller 86 is made of brushes such as acryl which is subjected to a conductive treatment. Further, while the intermediate transfer medium 64 is carrying a developer image, the scraper 84 and the brush roller 86 are separated from the intermediate transfer medium 64. The scraper 84 and the brush roller 86 integrally abut the intermediate transfer medium 64 at a prescribed timing The fixing device 90 is arranged above the secondary transfer position. The fixing device 90 has a heating roller 92 and a pressing roller 94, and fixes the developer image secondarily transferred by the secondary transfer roller 80 and the secondary transfer back-up roller 72, onto a recording medium, and conveys the recording medium toward the discharging roller 34.

An image forming unit 96 is formed by integrating the intermediate transfer device 62, the image carrier 50, the charging device 52, the image carrier cleaner 54 and the intermediate transfer medium cleaner 82. The image forming unit 96 is arranged beneath the discharging portion 36 of the first opening and closing door 16, and is attachable to or detachable from the main body 12 of the image forming apparatus by opening the first opening and closing door 16.

Further, a control unit 98 is arranged in the image forming apparatus 10 for control the respective parts of the image forming apparatus 10.

Next, the guide member 20 and its surrounding parts will be described in detail.

Figure 3:
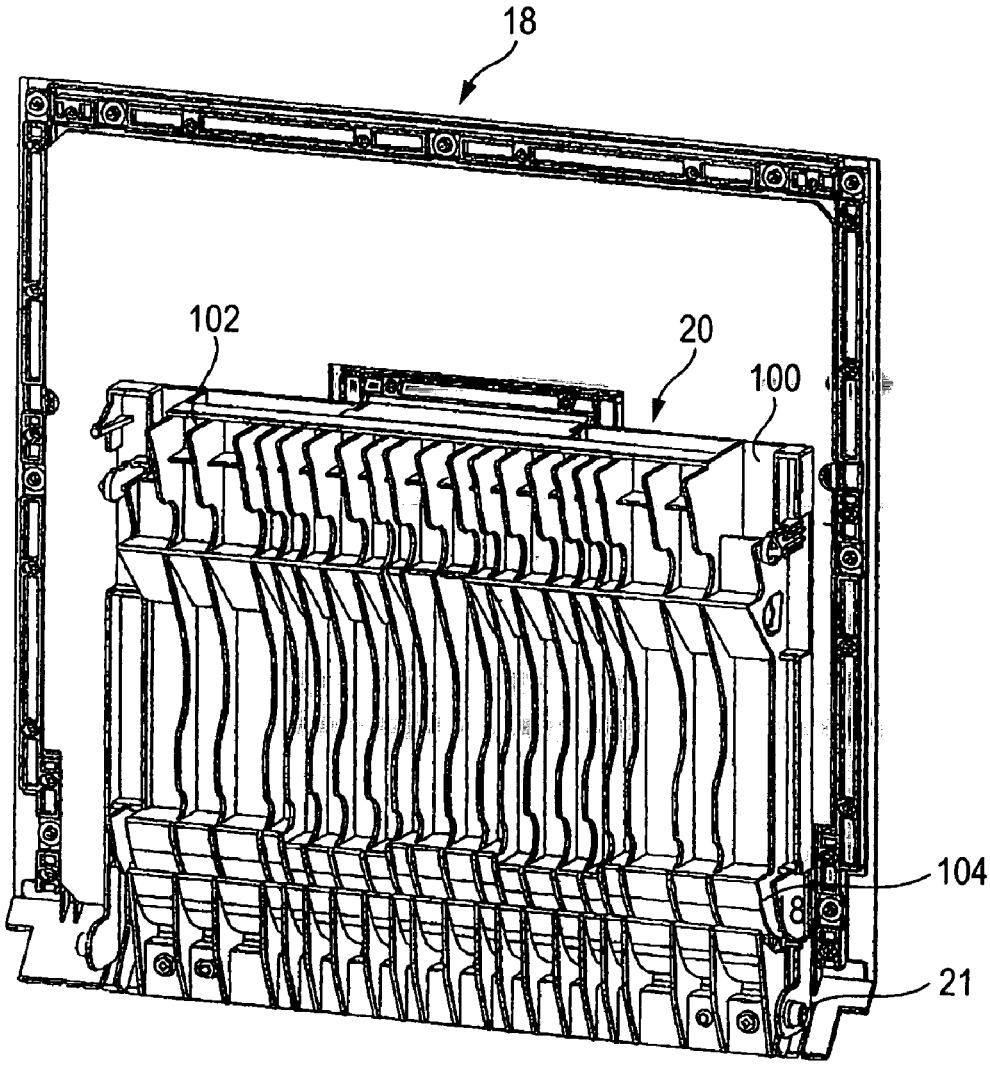
FIG. 3 is a perspective view showing a state in which a second opening and closing door is attached to a guide member.
Figure 4:
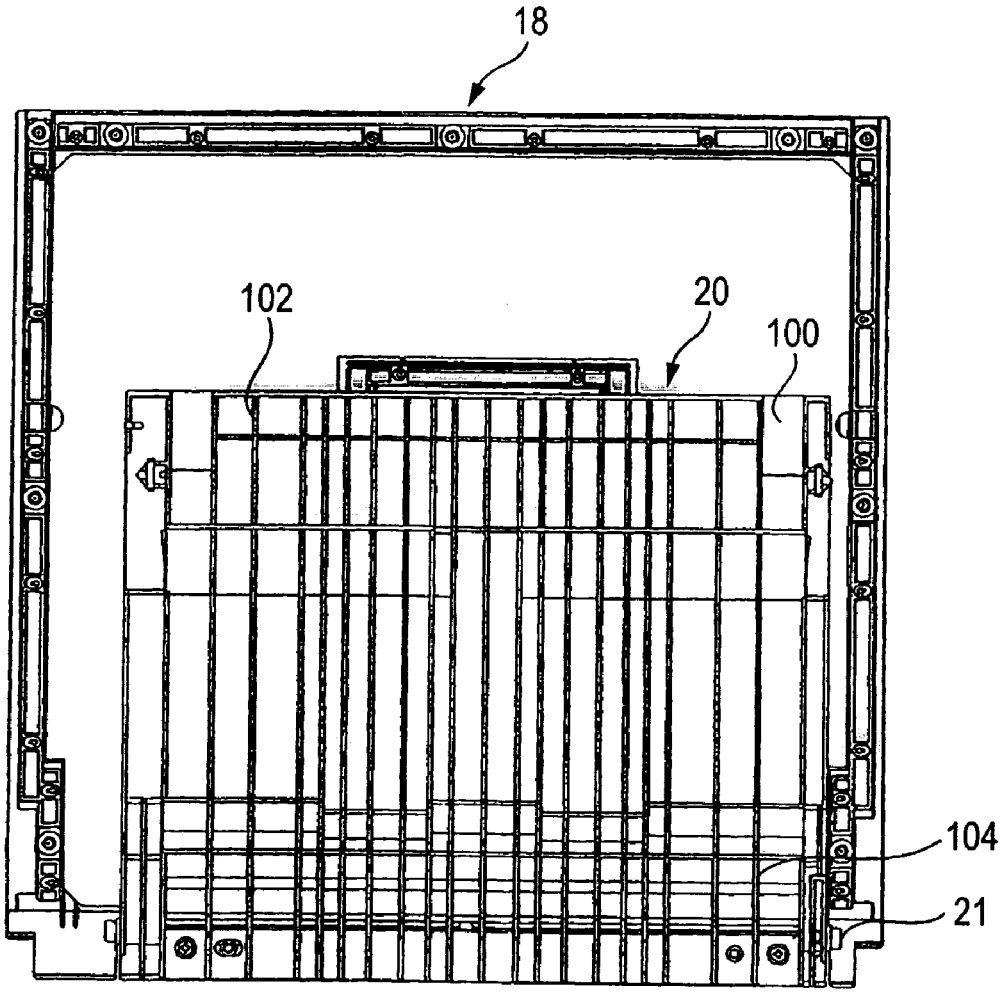
FIG. 4 is a front view showing a state in which the second opening and closing door is attached to the guide member, as seen from a conveying passage side.
Figure 5:
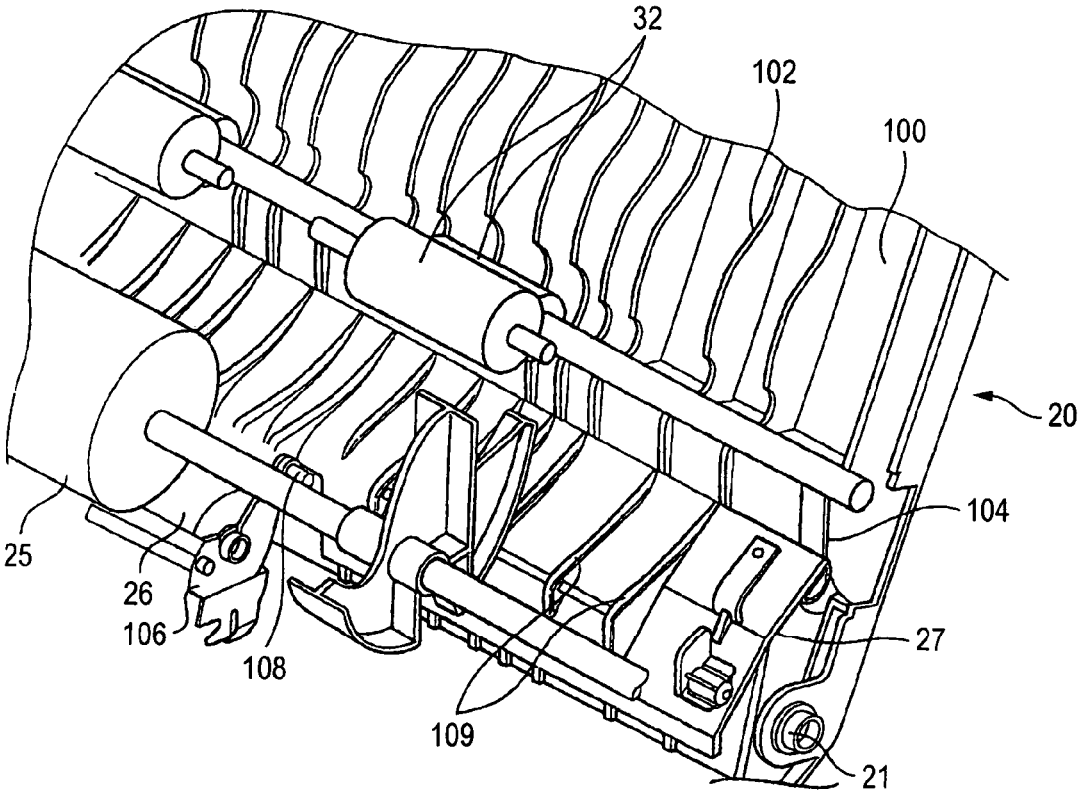
FIG. 5 is a detailed perspective view showing an area near and around a fulcrum of the guide member.

The guide member 20 and its surrounding parts will be described in detail in FIGS. 3 to 5.

The guide member 20 has a plate-shaped main body 100 in which many ribs 102 are formed to protrude toward the main body 12 of the image forming apparatus. The second opening and closing door 18 is attached to the rear face of the main body 100. Further, the guide member 20 rotates about the fulcrum 21 provided at its bottom end. A sliding contact portion 104, which comes in sliding contact with the movable member 27, is formed at the bottoms of the respective ribs 120.

The movable member 27 is rockably supported via a connecting member (not shown) about a supporting shaft 108 provided at an end of a holding member 106 which rotatably holds the retard roller 26. Also, a plurality of ribs 109 is formed on the movable member 27 for guiding a recording medium toward the conveying rollers 32. The ribs 109 constitute a part of the conveying passage 28 along with ribs 102 provided in the guide member 20. Further, when the guide member 20 opens on the rear side of the main body 12 of the image forming apparatus, the movable member 27 opens the conveying passage 28 while it comes in sliding contact with the sliding contact portion 104 of the guide member 20.

Accordingly, when the guide member 20 is closed, a recording medium fed by the feed roller 25 is guided to the conveying rollers 32 by the ribs 109 of the movable member 27, passes between the conveying rollers 32, and is guided to the resist roller 31 by the ribs 102 of the guide member 20.

Next, the second opening and closing door 18 attached to the guide member 20 will be described in detail.

Figure 6:
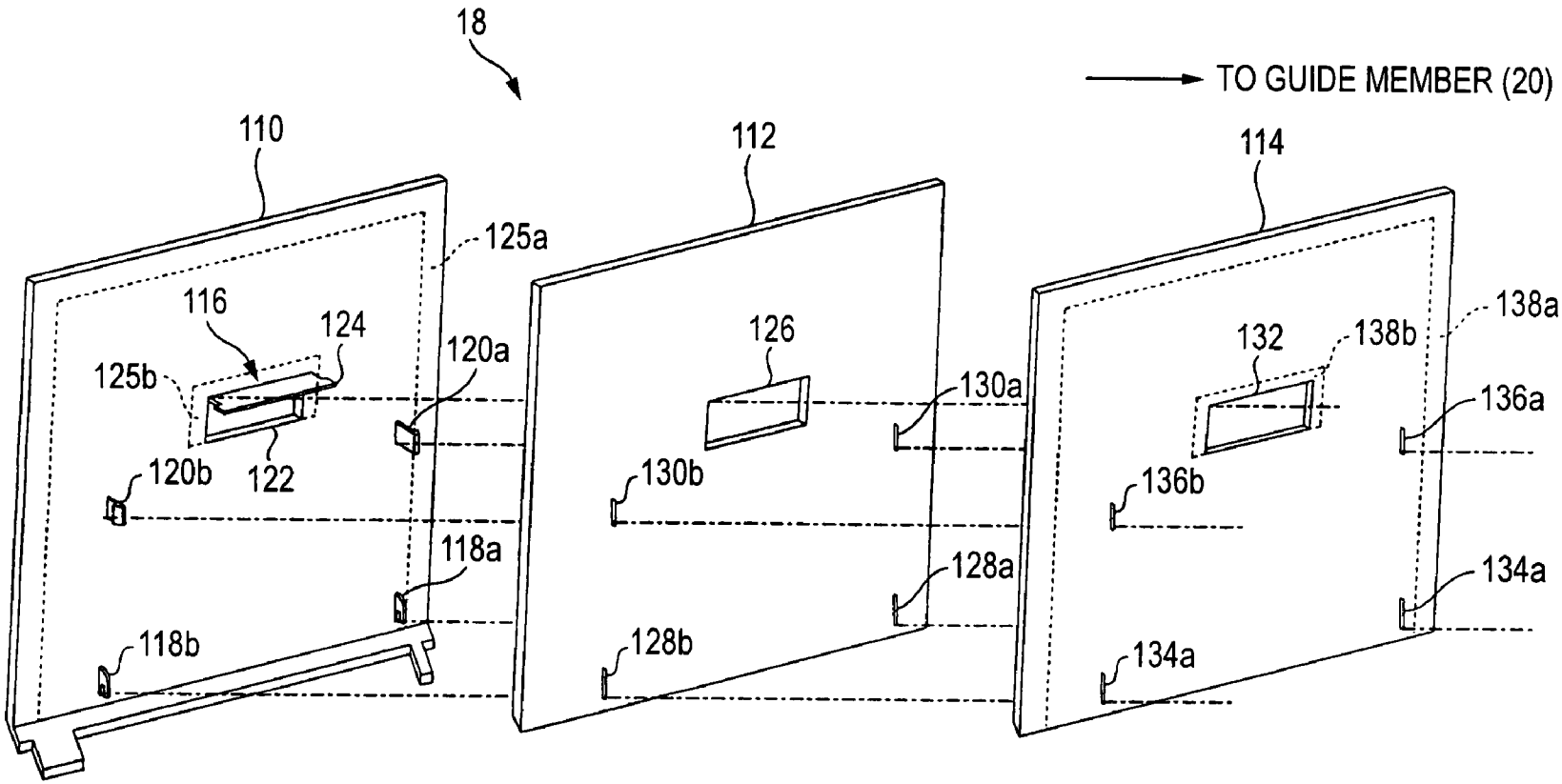
FIG. 6 is an exploded view showing a second opening and closing door.

FIG. 6 is an exploded view showing the second opening and closing door 18. The second opening and closing door 18 has a main body 110 of the second opening and closing door, a sound absorbing member 112 and a sound absorbing member cover 114.

The main body 110 of the second opening and closing door is a plate-shaped quadrangular member made of resin, provided with a gripping portion 116, engaging portions 118*a* and 118*b*, and elastic claws 120*a* and 120*b*. Each gripping portion 116 is composed of an opening 122 provided substantially at the central upper portion of the main body 110 of the second opening and closing door, and a protruding portion 124 protruding toward the inside of the main body 12 of the image forming apparatus. Further, the gripping portion 116 is designed to allow a user to put his/her hands into the opening 122 and grip the door. The second opening and closing door 18 is attached to the rear face of the guide member 20 by making the engaging portions 118*a* and 118*b* respectively engaged into receiving portions provided at a rear lower portion of the guide member 20 and by making the elastic claws 120*a* and 120*b* respectively engaged into holes provided at rear both sides of the guide member 20. In other words, the second opening and closing door 18 faces the conveying passage 28 via the guide member 20.

In addition, fixing areas 125*a* and 125*b* are provided at the upper portion and both sides of the main body 110 of the second opening and closing door and at the upper portion and both sides of the gripping portion 116 to integrally fix the main body 110 of the second opening and closing door, the sound absorbing member 112 and the sound absorbing member cover 114.

The sound absorbing member 112 is a fibrous sound absorbing member, for example, Thinsulate (Registered trademark), etc. designed to cover almost the entire surface of the main body 110 of the second opening and closing door facing the guide member 20 except the holes 126, 128*a*, 128*b*, 130*a*, and 130*b* through which the gripping portion 116, the engaging portions 118*a* and 118*b* and the elastic claws 120*a* and 120*b* pass, respectively.

The sound absorbing member cover 114 is made of a cloth material which covers almost the entire surface of the main body 110 of the second opening and closing door facing the guide member 20 except for the holes 132, 134*a*, 134*b*, 136*a* and 136*b* through which the gripping portion 116, the engaging portions 118*a* and 118*b* and the elastic claws 120*a* and 120*b* pass, respectively. The sound absorbing member cover 114 is dyed in dark color such as, for example, black, and is made of an antistatic-treated polyester fiber, a nylon fiber and PET (polyethylenterephthalate), and has air permeability. Further, the sound absorbing member 114 is designed to keep shielding the light by dying the sound absorbing member 114 in dark color such as black with a dye which does not contain carbon, and is designed not to float a carbon-containing fibrous material in the image forming apparatus 10.

Further, the fixing areas 138*a* and 138*b* are respectively provided at the upper side and both sides of the sound absorbing member cover 114 and at the upper and both sides of the hole 132 to integrally fix the main body 110 of the second opening and closing door, the sound absorbing member 112 and the sound absorbing member cover 114.

Specifically, in the second opening and closing door 118, the sound absorbing member 112 and the sound absorbing member cover 114 are laid one upon another in order on the guide member 20 side of the main body 110 of the second opening and closing door, and the fixing areas 125*a* and

125*b* of the main body 110 of the second opening and closing door and the fixing areas 138*a* and 138*b* of the sound absorbing member cover 114 are pressure-contacted with each other by the pressure-contact member (not shown) with the sound absorbing member 112 interposed between the main body 110 of the second opening and closing door and the sound absorbing member cover 114. Thereby, the body of the second opening and closing door 110, the sound absorbing member 112 and the sound absorbing member cover 114 are integrated together.

Further, as for the second opening and closing door 18, in a state in which the body of the second opening and closing door 110, the sound absorbing member 112 and the sound absorbing member cover 114 are integrated, the protruding potion 124, the engaging portions 118*a* and 118*b* and the elastic claws 120*a* and 120*b* protrude toward the guide member 20. The engaging portions 118*a* and 118*b* and the elastic claws 120*a* and 120*b* of the main body 110 of the second opening and closing are respectively engaged with the rear face of the guide member 20, so that the main body 110 of the second opening and closing door is adhered and attached to the rear face of the guide member 20 via the sound absorbing member 112 and the sound absorbing member cover 114.

In addition, the second opening and closing door 18 may be constructed by fixing a sound absorbing member (or a sound absorbing unit), which is dyed in dark color such as, for example, black with a dye which does not contain carbon (or a carbon-containing fibrous material), and which can absorb noise in the image forming apparatus 10, to the main body 110 of the second opening and closing door instead of the sound absorbing member 112 and the sound absorbing member cover 114.

Figure 7:
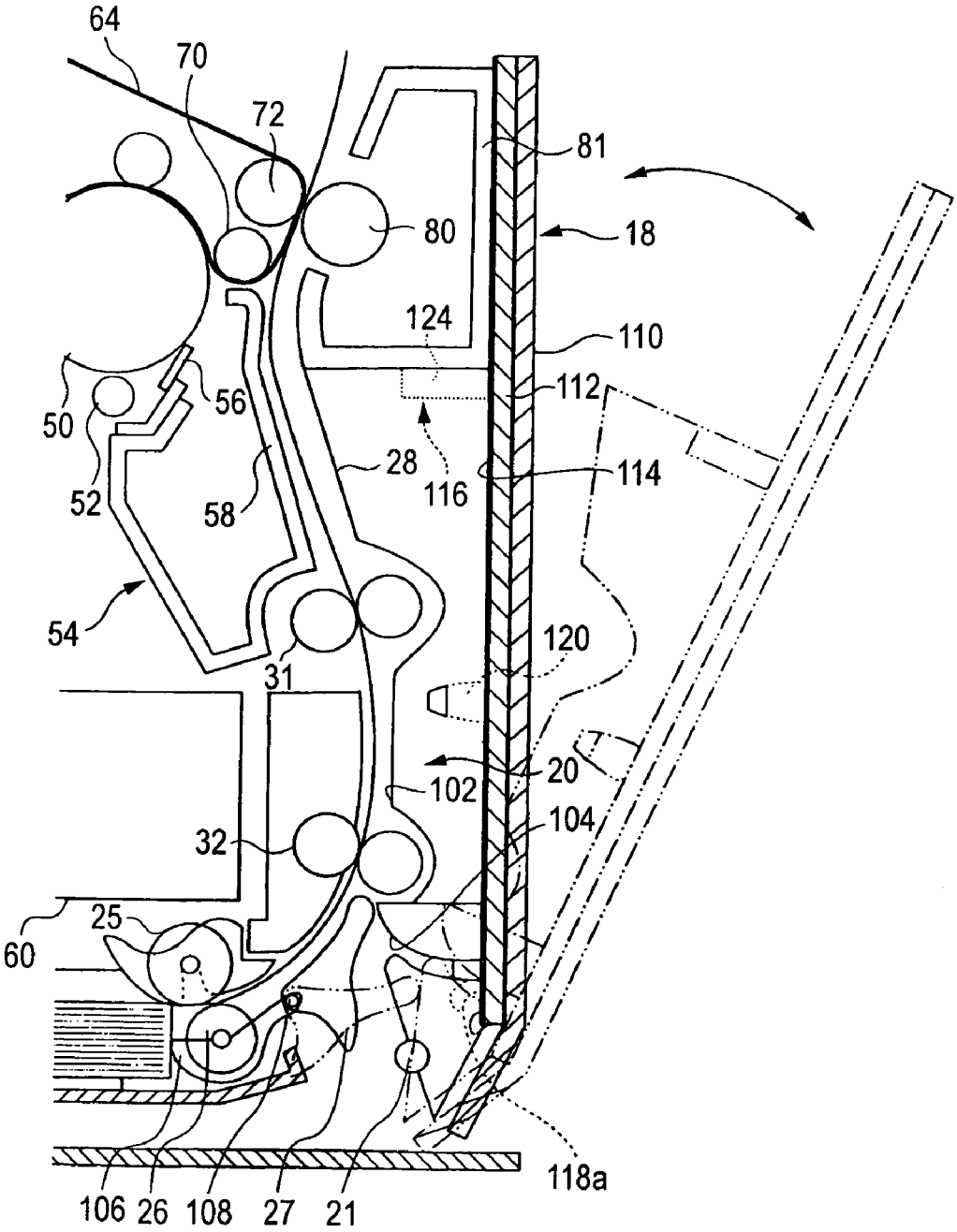
FIG. 7 is an enlarged side view showing an arrangement of a sound absorbing member attached to a main body of the second opening and closing door.
Figure 8:
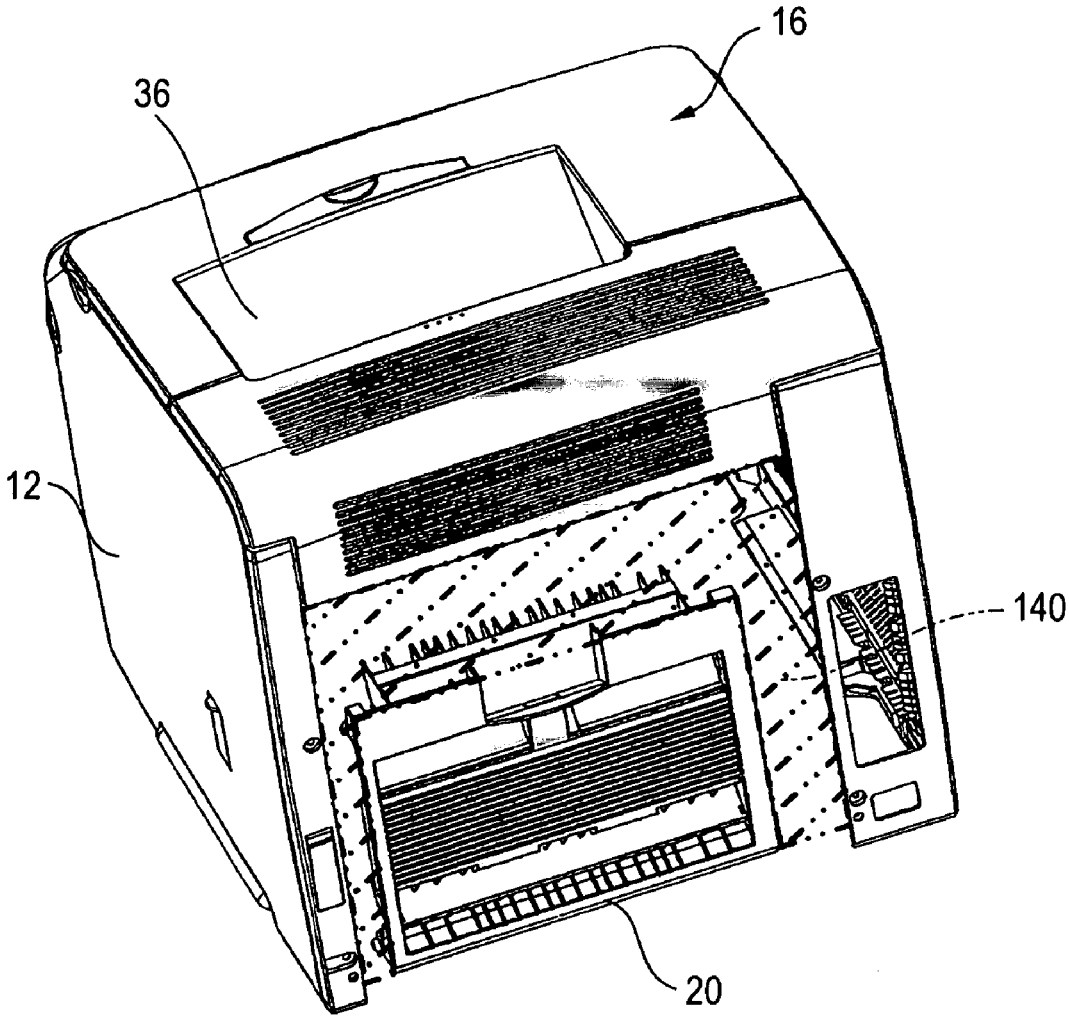
FIG. 8 is a perspective view showing a void between the main body of the image forming apparatus and the guide member.
Figure 9:
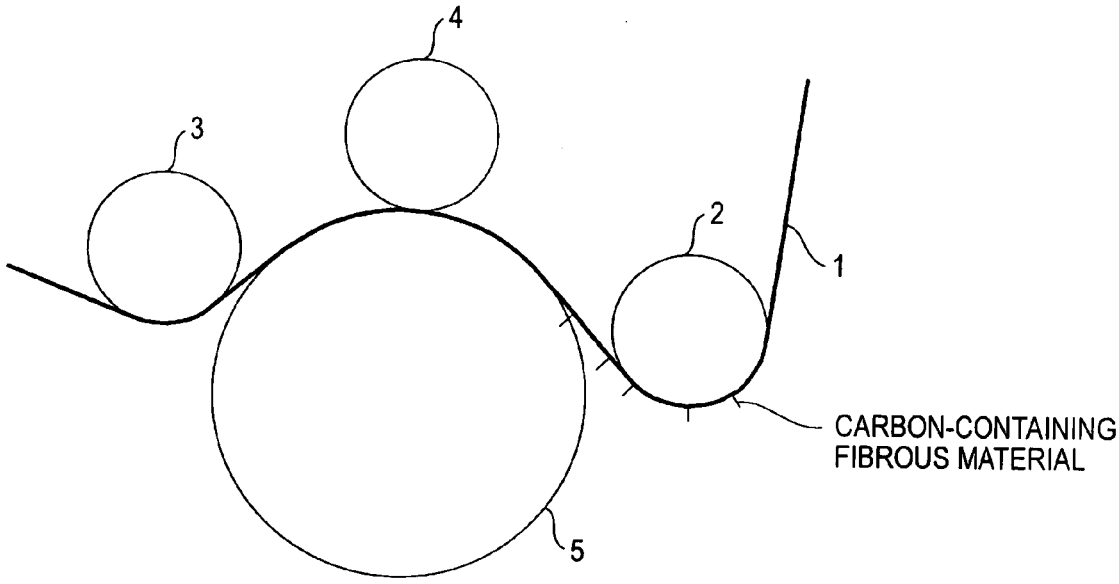
FIG. 9 is an enlarged view showing an area around an image carrier in a comparative example of the image forming apparatus.

FIG. 7 shows an arrangement of the sound absorbing member 112 attached to the main body 110 of the second opening and closing door. Further, FIG. 8 shows a void formed between the main body 12 of the image forming apparatus and the guide member 20.

When a recording medium passes through the conveying passage 28, a sound caused by sliding friction occurs because the recording medium comes in sliding contact with members constituting the conveying passage 28. In particular, when a recording medium abuts the resist roller 31 and the conveying rollers 32 and is then conveyed around the resist roller 31 and the conveying rollers 32, noise occurs while a recording medium is conveyed.

Meanwhile, a user can rotate the second opening and closing door 18 along with the guide member 20 around the fulcrum 21 and open the conveying passage 28 by griping the gripping portion 116 of the second opening and closing door 18. In other words, because the guide member 20 can be opened and closed along with the second opening and closing door 18, for example, when the conveying passage 28 is jammed up with a recording medium, the user can remove the recording medium jammed in the conveying passage 28 by opening the guide member 20. Here, since the guide member 20 which forms a part of the conveying passage 28 can be opened and closed, a void 140 exists between the main body 12 of the image forming apparatus and the guide member 20

As described above, the sound absorbing member 112 covers almost the entire surface of the main body 110 of the second opening and closing door facing the guide member 20. The second opening and closing door 18 is attached to the rear face of the guide member 20 so that it is arranged on the rear side of the conveying passage 28 including the rear faces (the right side in FIG. 7) of the resist roller 31 and the conveying rollers 32. Further, the surface of the main body 110 of the second opening and closing door, which is covered by the sound absorbing member 112, has a wider area than the area surrounded by the void 140, and the guide member 20 is closed along with the second opening and closing door 18, so that the sound absorbing member 112 seals up the void 140 via the sound absorbing member cover 114.

In this way, since the sound absorbing member 112 covers the rear face of the conveying passage 28 and seals up the void 140, a sound caused by sliding friction can be insulated when a recording medium passes through the conveying passage 28, so that noise does not leak from the rear side of the image forming apparatus 10.

In addition, a sound absorbing member is provided on the rear side of the main body 100 of the guide member 20 and the sound absorbing member is covered with a sound absorbing member cover, so that noise does not leak from the rear side of the image forming apparatus 10.

What is claimed is:

1. An image forming apparatus comprising:

an image carrier for carrying a charged developer image;

a main body of the image forming apparatus for accommodating the image carrier; and a sound absorbing unit which prevents a noise source inside the main body of the image forming apparatus from leaking out of the main body of the image forming apparatus;

wherein the sound absorbing unit is dyed in a dark color with a dye.

2. The image forming apparatus according to claim 1, wherein the dye does not contain carbon.

3. The image forming apparatus according to claim 1, wherein the sound absorbing unit is dyed black.

4. The image forming apparatus according to claim 1, wherein the sound absorbing unit is provided inside an opening and closing door facing a conveying passage for conveying a recording medium.

5. The image forming apparatus according to claim 4, wherein the opening and closing door faces the conveying passage via a guide member.

6. The image forming apparatus according to claim 5, wherein the sound absorbing unit is arranged to cover a void formed between the main body of the image forming apparatus and the guide member.

7. An image forming apparatus comprising:

an image carrier for carrying a charged developer image;

a main body of the image forming apparatus for accommodating the image carrier;

a sound absorbing member which prevents a noise source inside the main body of the image forming apparatus from leaking out of the main body of the image forming apparatus; and a sound absorbing member cover for covering the sound absorbing member;

wherein the sound absorbing member cover is dyed in a dark color with a dye.

8. An image forming apparatus comprising:

an image carrier for carrying a charged developer image;

a main body of the image forming apparatus for accommodating the image carrier;

a sound absorbing member which prevents a noise source inside the main body of the image forming apparatus from leaking out of the main body of the image forming apparatus; and a sound absorbing member cover for covering the sound absorbing member;

wherein the sound absorbing member cover is dyed in a dark color with a dye which does not contain carbon.

9. The image forming apparatus according to claim 7, wherein the dye does not contain carbon-containing fibrous material.

10. The image forming apparatus according to claim 7, wherein the sound absorbing member cover is dyed black.

11. The image forming apparatus according to claim 7, wherein the sound absorbing member and the sound absorbing member cover are provided inside an opening and closing door facing a conveying passage for conveying a recording medium.

12. The image forming apparatus according to claim 11, wherein the opening and closing door faces the conveying passage via the guide member.

13. The image forming apparatus according to claim 12, wherein the sound absorbing member and the sound absorbing member cover are arranged to cover a void formed between the main body of the image forming apparatus and the guide member.

* * * * *